United States Patent [19]

Kameda

[11] 4,421,958

[45] Dec. 20, 1983

[54] PANEL KEYBOARD WITH AIR PERMEABLE SPACER

[75] Inventor: Eiichi Kameda, Kukizaki, Japan

[73] Assignee: Nippon Mektron Co., Ltd., Japan

[21] Appl. No.: 271,041

[22] Filed: Jun. 5, 1981

[30] Foreign Application Priority Data

Jun. 10, 1980 [JP] Japan ..... 55-078674

[51] Int. Cl.[3] ..... H01H 13/70

[52] U.S. Cl. ..... 200/5 A; 200/159 B; 200/306; 200/86 R

[58] Field of Search ..... 200/5 A, 86 R, 159 B, 200/306

[56] References Cited

U.S. PATENT DOCUMENTS

| | | | |
|---|---|---|---|
| 2,954,446 | 9/1960 | Wikkerink | 200/86 R |
| 3,627,927 | 12/1971 | Schmitz et al. | 200/159 B X |
| 3,898,421 | 8/1975 | Suzumura | 200/159 B |

*Primary Examiner*—J. R. Scott

*Attorney, Agent, or Firm*—David S. Fishman

[57] ABSTRACT

A membrane switch assembly having an apertured air permeable spacer positioned between a pair of printed circuits. Air may diffuse through the permeable material into and out of the regions which define individual switch cavities during operation.

10 Claims, 5 Drawing Figures

PANEL KEYBOARD WITH AIR PERMEABLE SPACER

BACKGROUND OF THE INVENTION (1) Field of the Invention

The present invention is directed to improved membrane switch assemblies. Specifically, this invention relates to a membrane switch assembly having internal cavities which are vented to the ambient atmosphere through a porous or air permeable structure.

(2) Description of the Prior Art

Prior art membrane switch assemblies of the type employed in miniaturized keyboards have customarily been constructed by laminating an apertured spacer sheet between two substrates which support printed circuits. The substrates, at least one of which will be flexible, are positioned so that circuit patterns thereon face each other. The switches are defined by locating the spacer sheet apertures so that, with the application of pressure to one of the substrates, appropriate portions of the printed circuits can be made to contact each other. These prior art membrane switch assemblies were usually constructed so that the switch cavities or chambers formed by the apertures within the spacer sheet were permanently sealed from the surrounding environment. These cavities were filled with a gas, typically air.

The above-discussed prior art method of constructing membrane switch assemblies has certain disadvantages. A major disadvantage which results from hermetically sealing the cavities defined by the spacer sheet apertures occurs when there is a change in the external fluid pressure, the atmospheric pressure for example. If a machine which incorporates the membrane switch assembly is located at an altitude where the outside atmospheric pressure is less than the pressure within the sealed cavities, the greater internal pressure exerts an outward force upon the layers of the switch laminate. The result of this outward expansion is that there is a cushioning effect to the operation of the individual keys. With a sufficiently large pressure differential, it becomes difficult for the operator to determine whether the key has been activated. In the extreme situation, when the difference between the outside atmospheric pressure and the pressure within the cavities is quite large, the membrane switch assembly may become distorted with structural damage possibly being caused by the increasing pressure on the laminate walls caused by the outward expansion.

A similar result occurs when the outside atmospheric pressure becomes greater than the pressure within the cavities. This will occur, for example, when the mechanism incorporating the membrane switch assembly is operated in an environment where the ambient pressure is greater than that where the laminate was constructed. The result would be that the force exerted upon the wall of the laminate by the outside atmospheric pressure would move the walls of the laminate inwardly. The usual effect of this pressure differential would not be as significant as when the atmospheric pressure is less than the internal pressure. However, in the extreme condition when the pressure differential between the outside atmospheric pressure and the internal pressure becomes great, the switch might be activated.

It is to be observed that, even under normal operating conditions, the gas which is in the cavities resists compression of the walls of the laminate when a user tries to activate the keys. This results in a cushioning effect which is felt by the user of prior art membrane switch assemblies. While under certain circumstances a cushioning effect may be desirable, it may also reduce the users ability to activate a switch, by depressing a key for example, or detect whether a switch has been actuated.

Several methods have been proposed and/or utilized to try to alleviate the above-discussed disadvantges of prior art membrane switch assemblies. One proposed prior art method involves incorporating internal channels within the laminate between the cavities. This allows displacement of the fluid medium between the internal cavities of the membrane switch assembly. When one switch is activated the fluid within the spacer sheet defined cavity associated with that switch is displaced by the downward force of the membrane wall and will flow through the channels into one or more other cavities. While this will help to minimize the cushioning effect caused by the resistance of the internal pressure to the downward depression of the membrane wall, it will not alleviate the problems associated with an internal/external pressure differential.

It has also been proposed to equalize the internal pressure with the external pressure by establishing fluid communication between the ambient atmosphere and the interior of the switch assembly by providing a hole in the outer layers of the membrane switch assembly; commonly referred to as a through-hole. This through-hole in the laminate of the switch assembly allows air to flow freely into and out of the assembly's cavities. While this technique would solve the problems associated with the pressure differential between the external-/internal pressures, it creates some of its own disadvantages. The major of these disadvantages becomes apparent with the incorporation of the completed membrane switch assembly into a final product. The through-hole vents would typically be provided through the entire switch assembly. Although holes in the front surface of the assembly may be sealed off, for example by indicia bearing sheets, the holes at the back surface must remain clear. This causes difficulties when installing the switch laminate into products such as calculators, microwave ovens, thermostatic controls, etc. The membrane switch assembly would, to keep the through-hole open, have to be either spatially separated from the surrounding housing or the surrounding housing would have to be provided with corresponding holes to allow for a free flow of air into and out of the through-holes. This requires additional manufacturing steps or a larger housing to provide the spatial separation. Furthermore, since many membrane switch assemblies are secured within the final product through uses of adhesives, during manufacturing, special care would be required to avoid having the adhesive flow into or seal off the through-hole vents. Finally, free flow between the ambient atmosphere and the interior of the switch assembly enhances the possibility of dirt or other contaminants reaching the switch contacts and causing faulty operation.

SUMMARY OF THE INVENTION

The present invention overcomes the above-discussed disadvantages and other deficiencies of the prior art by providing a novel and improved membrane switch assembly.

In accordance with the present invention a membrane switch assembly is comprised of two circuit bearing layers and a spacer sheet comprised of a porous material. This porous material may, for example, be a fibrous or filter medium comprising nonwoven, entangled or arranged fibers. The porous spacer sheet is provided with cutouts to define the individual key areas and is hermetically sealed between the two printed circuits.

When an individual switch is activated the air within the switch area or cavity is forced out through the minute passageways of the porous material.

The use of a porous material, as the spacer sheet within a switch assembly, not only overcomes the disadvantages of prior art hermetically sealed switch assemblies, such as the cushioning effect upon activation of keys, but also prevents environmental deterioration to the electronic circuits, by filtering the air as it flows into and out of the individual key areas. Furthermore, the use of the porous material allows the spacer sheet to function as a stress dispersing agent. As an individual switch is activated the spacer sheet will be slightly compressed and excess forces associated with switch operation will be spread throughout the sheet. Thus, any desired mode of mounting the switch assembly is made possible.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several FIGURES and wherein.

DESCRIPTION OF THE PREFERRED EMBODIMENT

The present invention is directed to switch assemblies for electronic equipment. These switch assemblies are provided with two nonconductive substrates or printed circuit boards, at least one of which is flexible, which carry conductive circuit patterns. These circuit patterns are arranged so as to face one another. In order to prevent electrical contact between these conductive circuit patterns, and thereby define an array of normally open switches, a sheet of nonconductive material is placed between the two substrates. This nonconductive spacing sheet is provided with apertures at desired locations, so that the circuit patterns on the two substrates can be placed into electrical contact with each other by deflecting one or both nonconductive substrates towards each other through the hole provided in the spacing sheet. Two such prior art switch assemblies are represented in FIGS. 1 and 2.

Figure 1:
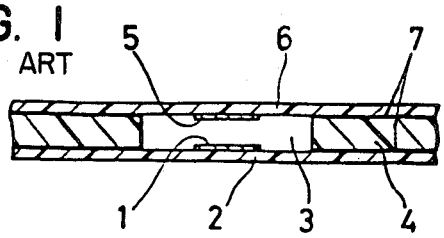
FIG. 1 PRIOR ART
FIG. 1 is a cross-sectional view of one type of prior art switch.

In FIG. 1 the nonconductive substrates, indicated at 2 and 6, carry respective conductive patterns 1 and 5, which are positioned so as to face each other. The substrates 2 and 6 are separated by spacing sheet 4. While both layers 2 and 6 may be comprised of a flexible polymeric material, it is sometimes preferable to form one of the layers from a rigid polymeric or similar material so that it may function as a support base. The spacer sheet 4 is provided, at desired locations, with apertures which define switch cavities such as indicated at 3. By compressing layer 6 towards layer 2 electrical contact may be established between conductive patterns 5 and 1. This switch assembly is hermetically sealed by a nonconductive adhesive 7 which is applied between the substrates 6 and 2 and spacing sheet 4.

Figure 2:
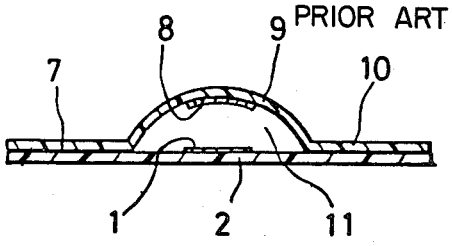
FIG. 2 PRIOR ART
FIG. 2 is a cross-sectional view of another type of prior art switch.

Referring to FIG. 2, another prior art switch assembly is represented. The assembly of FIG. 2 is similar to the assembly of FIG. 1 except for the lack of a spacing sheet. In the FIG. 2 assembly the two nonconductive substrates 2 and 10 carry conductor patterns 8 and 1. Layer 10 is further provided with a dome-shaped portion 9 which is capable of being distorted so as to establish electrical contact between the circuit patterns 8 and 1. The distortion of dome-shaped portion 9 is known as a click or snap-through center operation. The layers 2 and 10 are hermetically sealed to one another by a nonconductive adhesive 7. This results in the area 11 under dome 9 being a sealed switch cavity.

As stated above prior art switch assemblies of the type represented in FIGS. 1 and 2 are typically hermetically sealed in order to prevent environmental deterioration of the circuit patterns. This hermetic sealing of the switch assembly entraps air within the switch cavities, 3 and 11. Operation of the switches is inhibited by this incompressible trapped air. Additional disadvantages of these prior art sealed switch assemblies have already been discussed above.

Figure 3:
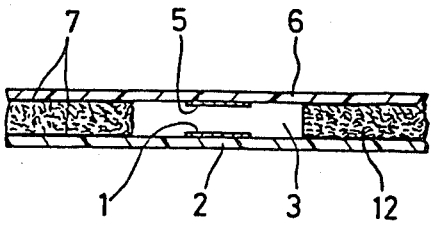
FIG. 3 is a cross-sectional view of a switch, similar to the switch shown in FIG. 1 with the addition of a porous spacer sheet in accordance with the present invention.

The present invention overcomes the above-discussed problems by employing a spacing sheet comprised of a porous material which allows air flow in and out of the spaces which define the individual switch cavities. With reference to FIG. 3, a switch assembly is shown which is similar to that shown in FIG. 1; with similar components having the same reference numerals. The nonconductive substrates 2 and 6 are provided with opposing circuit patterns 1 and 5. These layers 2 and 6 are separated by and adhered to a spacing sheet 12, which is comprised of a porous material, by means of an adhesive 7. The porous material comprising sheet 12 allows air to flow into and out of the cavity 3, when the individual switch is activated.

Figure 4:
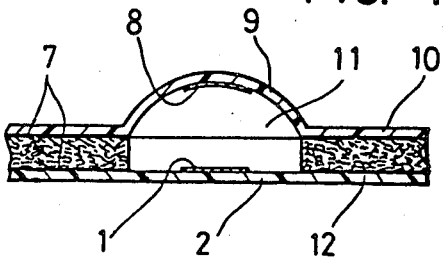
FIG. 4 is a cross-sectional view of a switch assembly, similar to the switch of FIG. 2 with the addition of a porous spacer sheet in accordance with the present invention.

Referring now to FIG. 4, a switch assembly is shown which is similar to the assembly of FIG. 2. Here again, the nonconductive layers 2 and 9 are provided with conductive circuit patterns 1 and 8. Layer 10 is also provided, at predetermined locations, with dome-shaped portions 9 which may be deflected towards the layer 2. The layers 2 and 10 are separated by a spacing sheet 12 which is comprised of a porous material. Layers 2 and 10 are bonded to layer 12 by a nonconductive adhesive 7.

The porous material comprising the spacing sheet of the present invention may be any material which will allow the passage of air into and out of the switch cavities. This porous material should also have a compressibility and thickness which will allow the establishment of electrical contact between the opposing circuit patterns through the apertures therein which define the switch cavities. Materials suitable for the spacer sheet of the present invention may include fibrous materials or filter materials. Thus, sheet 12 may, consist of nonwoven fabrics, such as felt, which have either an irregular arrangement or an entangled arrangement of fibers. The sheet 12 may also consist of a fabric which has an array of fibers specifically arranged in a porous structure.

Figure 5:
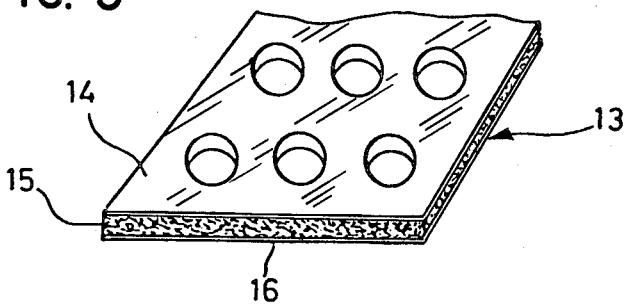
FIG. 5 is a perspective view of a spacer sheet in accordance with one embodiment of the present invention.

Referring to FIG. 5 a spacer sheet in accordance with the present invention is indicated generally at 13. The sheet 13 is comprised of a porous layer 15 having its two opposing surfaces covered with thin plastic films 14 and 16. Films 14 and 16 are bonded to the surfaces of porous material layer 15. This provides a spacer structure which may be easily bonded between two printed circuits. Sheet 13 is further provided with at least one cutout which defines a switch cavity within the switch assembly. While FIG. 5 illustrates a sheet 13 comprising a porous layer 15 sandwiched between two film layers 14 and 16, it should be apparent to those skilled in the art that the spacing sheet of a switch assembly may be similarly comprised of only a porous material bonded directly between the two printed circuit substrates.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A membrane switch assembly comprising:

first circuit means, said first circuit means comprising a flexible planar nonconductive substrate having a conductive circuit pattern supported on at least a first surface thereof;

second circuit means, said second circuit means including a nonconductive substrate having a conductive circuit pattern supported on at least a first surface thereof, said circuit pattern of said second circuit means facing said circuit pattern of said first circuit means and being at least partly in registration therewith; and nonconductive spacer means, said spacer means being disposed between said first and said second circuit means, said spacer means including at least a first aperture extending therethrough, said aperture being aligned with registered circuit portions on said circuit means whereby electrical contact between registered portions of said circuit pattern of said first circuit means and said circuit pattern of said second circuit means may be established through said spacer means aperture, said aperture cooperating with said circuit means to define a cavity between said first and said second circuit means, said spacer means comprising a sheet of resilient gas permeable material through which gas may flow into or out of said cavity from or to adjacent peripheral regions of the membrane switch assembly.

2. The assembly of claim 1 wherein said spacer sheet is comprised of nonwoven fiber sheet material.

3. The assembly of claim 1 wherein said spacer sheet is comprised of entangled fiber sheet material.

4. The assembly of claim 1 wherein said spacer sheet is comprised of fiber sheet material.

5. The assembly of claim 1 wherein said spacer means is adhesively bonded to said circuit means.

6. The assembly of claim 5 wherein said spacer means is provided with an array of apertures and wherein said first circuit means includes an outwardly extending protrusion in alignment with each of said spacer means apertures.

7. The assembly of claim 6 wherein said spacer means further comprises:

a film of gas impermeable material on at least a first surface of said sheet of gas permeable material, said film being in abutting relationship to one of said circuit means.

8. The assembly of claim 1 wherein said spacer means is porous and defines nonlinear gas flow paths whereby said spacer means filters particulate matter from gas passing therethrough.

9. A membrane switch assembly comprising:

first circuit means, said first circuit means comprising a flexible planar nonconductive substrate having a conductive circuit pattern supported on at least a first surface thereof;

second circuit means, said second circuit means including a nonconductive substrate having a conductive circuit pattern supported on at least a first surface thereof, said circuit pattern of said second circuit means facing said circuit pattern of said first circuit means and being at least partly in registration therewith; and nonconductive spacer means, said spacer means being disposed between said first and said second circuit means, said spacer means including at least a first aperture extending therethrough, said aperture being aligned with registered circuit portions on said circuit means whereby electrical contact between registered portions of said circuit pattern of said first circuit means and said circuit pattern of said second circuit means may be established through said spacer means aperture, said aperture cooperating with said circuit means to define a cavity between said first and said second circuit means;

said spacer means being adhesively bonded to at least one of said circuit means and comprising a sheet of gas permeable material and a film of gas impermeable material on at least a first surface of said sheet of gas permeable material, said film being in abutting relationship to one of said circuit means and having a pattern of apertures therethrough which are in alignment with the apertures in said sheet of gas permeable material.

10. The assembly of claim 9 wherein said spacer means is provided with a film of gas impermeable material on a second surface oppositely disposed from said first surface said film on said second surface also having said pattern of apertures therethrough and in alignment with the aperture in said sheet of gas permeable material.

* * * * *